United States Patent [19]

Kaufmann

[11] 4,183,380

[45] Jan. 15, 1980

[54] LEASE RODS FOR TEXTILE APPARATUS

[75] Inventor: Frank H. Kaufmann, Greenville, S.C.

[73] Assignee: Steel Heddle Manufacturing Company, Greenville, S.C.

[21] Appl. No.: 919,261

[22] Filed: Jun. 26, 1978

[51] Int. Cl.[2] ..... D03D 49/22

[52] U.S. Cl. ..... 139/98

[58] Field of Search ..... 139/98, 436; 28/198, 28/199, 200

[56] References Cited

U.S. PATENT DOCUMENTS 3,687,171 8/1972 Strauss ..... 139/436

FOREIGN PATENT DOCUMENTS 570765 2/1933 Fed. Rep. of Germany ..... 139/98

*Primary Examiner*—Henry Jaudon

*Attorney, Agent, or Firm*—Zachary T. Wobensmith, 2nd; Zachary T. Wobensmith, III

[57] ABSTRACT

A lease rod for textile apparatus including weaving looms and drawing in machines is disclosed comprising central enlongated hollow metal tube with inserted end tips preferably of molded synthetic plastic material the ends of the tube being disposed at an angle for engagement of complemental surfaces, the angular disposition of the engaging surfaces facilitating insertion into the system of warp threads to be separated and reducing the tendency of the threads to catch at the intersection and the end tips decreasing in thickness while spreading and with rounded surfaces to facilitate insertion into the thread systems.

5 Claims, 6 Drawing Figures

LEASE RODS FOR TEXTILE APPARATUS

BACKGROUND OF THE INVENTION

1. Field of the Invention

This invention relates to lease rods for use with textile apparatus.

2. Description of the Prior Art

Lease rods have been employed in textile apparatus and have been of various shapes and materials.

Early lease rods were of polished wood which had a tendency to distort.

Chrome plated lease rods, also known as split or burster rods, have been made from tubular steel for many years. The ends are pointed by flattening the tube, brazing the edges and thoroughly smoothing all corners. The pointed ends, together with a polished chrome plated finish aid in the insertion of the rods between the warp sheets without snagging the individual threads.

Kelly, in U.S. Pat. No. 624,658 shows solid and hollow lease rods with integral tapered ends, rods of circular cross section not being desired.

Hastings, in U.S. Pat. No. 94,957 shows lease rods of circular cross section having end portions with grooves of reduced diameter which would made insertion more difficult.

Berry, in U.S. Pat. No. 263,303 shows a lease rod of flattened hollow tubular construction, grooved along its edges with end inserts of wood, one of which is tapered.

Hirschburger, in U.S. Pat. No. 2,935,780 shows solid lease rods of different cross section but does not show their ends.

Jungbluth, in British Pat. No. 7,453 of 1888 shows lease rods of flattened hollow tubular construction with integral tapered ends.

Elsberg Gompertz K. G., in German Pat. No. 570,765 shows lease rods of hollow tubular construction with pointed end inserts of decreasing cross section but the joint between the tube and the insert would be susceptible to snagging upon insertion into the thread system.

None of the foregoing have end inserts with a bias joint to prevent snagging nor do they have end inserts widened to facilitate insertion with the thread system.

SUMMARY OF THE INVENTION

In accordance with the invention a lease rod is provided suitable for use in weaving looms, and for warp preparation and drawing in which includes a central hollow elongated metal tube with ends disposed in a plane at an angle to the central axis of the tube and having inserted end tips preferably of molded synthetic plastic material secured in place and with surfaces in engagement with the tube ends, the end inserts having diverging portions of decreasing dimension and with rounded surfaces, the meeting portion of the end tips and the central rod and the shape of the end tips facilitating the insertion of the lease rod with the thread system without catching on the threads.

It is the principle object of the invention to provide a lease rod which is simple and sturdy in construction, and which will overcome the shortcomings of lease rods heretofore available and specifically which is free from any tendency to catch on threads of the thread system upon insertion.

It is a further object of the invention to provide a lease rod having inserted ends with a bias joint between a tubular rod and an end insert.

It is a further object of the invention to provide a lease rod which avoids the expense and difficulty in preparing smoothly formed ends on tubular rods and utilizes inserted plugs so constructed as to avoid snagging.

It is a further object of the invention to provide a lease rod which does not require expensive working of a tubular component.

It is a further object of the invention to provide a lease rod of the character aforesaid which employs inserted end plugs which can be replaced, if accidentally injured.

It is a further object of the invention to provide a lease rod having an end portion with a lease string groove on its tapered end.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Figure 1:
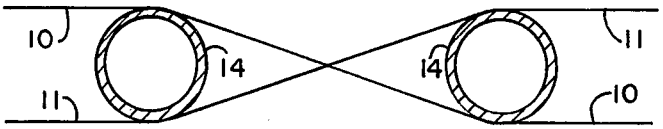
FIG. 1 is a vertical sectional view of a warp thread system with the central portions of lease rods in accordance with the invention inserted therein.

Referring now more particularly to the drawings, a thread system is shown in FIG. 1 in which groups of threads 10 and 11 are intended to be maintained in separate planes.

Figure 2:
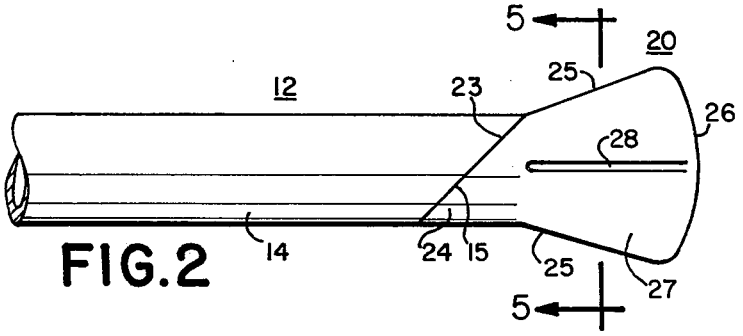
FIG. 2 is a top plan view of a portion of one end of a lease rod in accordance with the invention.
Figure 3:
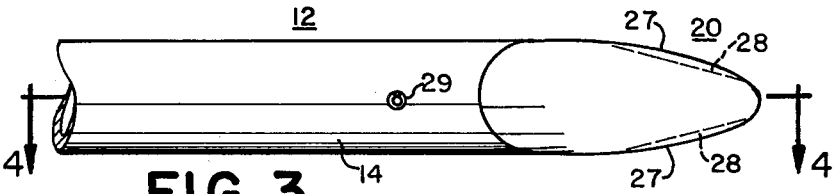
FIG. 3 is a side elevational view of the portion of the lease rod shown in FIG. 2.
Figure 6:
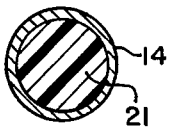
FIG. 6 is a transverse sectional view taken approximately on the line 6—6 of FIG. 4.

The lease rod of the present invention, as shown in FIGS. 2 and 6, one end of which is shown generally at 12 includes a tube 14 of a length in accordance with the width of the thread system 10, 11. The tube 14 can advantageously be of steel tubing, in one specific embodiment having an outside diameter of three quarters of an inch and with any desired exterior finish.

The tube 14 has a plane end face 15 at an angle, preferably 45°, with respect to the longitudinal central axis of the tube 14.

An end tip 20 is provided having a cylindrical stem 21 of a length of one and one half inches with a chamfered end 22 for insertion within the tube 14 on an inclined rim 23 complemental to the end face 15.

The end tip 20 has extending from the shortest portion of the rim 23, a cylindrical portion 24 of the same external diameter as that of the tube 14.

Figure 4:
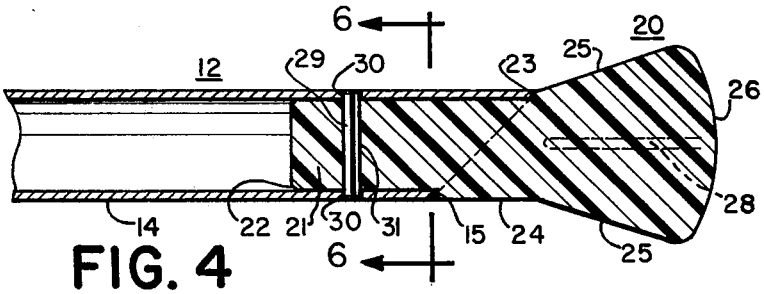
FIG. 4 is a horizontal sectional view taken approximately on the line 4—4 of FIG. 3.
Figure 5:
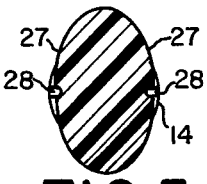
FIG. 5 is a transverse sectional view taken approximately on the line 5—5 of FIG. 2.

The end tip 20 is of a flattened configuration having outwardly flaring margins 25 of a maximum width of one and five sixteenths inch, with a curved terminus 26 having a radius as seen in FIGS. 2 and 4 of one and one quarter inches, the tip 20 from the cylindrical portion 24 and between the margins 25 being rounded and tapered, as at 27, to the terminus 26 to the flattened flared shape facilitating insertion in the thread system.

In the faces of the rounded and tapered portions 27 longitudinal lease string grooves 28 are provided so that a lease string (not shown) may be looped over the terminus 26.

The stem 21 can be secured in place in any desired manner such as by an interference fit, or by an adhesive but is shown as held by a transverse rivet or pin 29 extending through openings 30 in the tube 14 and an opening 31 in the stem 21.

The end tip 20 can be made of any suitable material which is reasonably gouge proof and preferably of synthetic molded plastic. Typical synthetic plastics include nylon, acetal, polycarbonate and polypropylene but others may also be used.

The mode of use is essentially the same as with prior lease rods but the bias joint between the tube 14 and the end tip 20 avoiding snagging and the flattened flared shape tending to stabilize the movement of the rod across the warp ends.

During rod insertion, if desired a lease string (not shown) may be looped over the terminus 26 of the end tip 20 and in the grooves 28 and held in position by back tension for movement across the warp sheet. The rod 12 can then be retracted leaving the string in position.

I claim:

1. A lease rod comprising an elongated metal tubular portion having a smooth exterior surface for engagement by a system of threads, and a flattened end tip formed of plastic material carried by said tubular portion, said tubular portion having an inclined end face disposed at an angle to the longitudinal axis of the tubular portion, said end tip having a stem extending into the tubular portion, and a an inclined rim in abutting engagement with said end face of said tubular portion.

2. A lease rod as defined in claim 1 in which said tubular portion has an interior circular in transverse cross section, and the stem of said end tip is complemental to the interior of said tubular portion.

3. A lease rod as defined in claim 1 in which said angle is of the order of 45°.

4. A lease rod as defined in claim 1 in which said end tip has flared side margins and a curved end terminus connecting said flared margins said end tip between said tubular portion and said terminus has faces converging toward said end terminus.

5. A lease rod as defined in claim 1 in which said end tip is secured to said tubular portion by a pin.

* * * * *